United States Patent [19]

Bliss

[11] Patent Number: 4,807,650

[45] Date of Patent: Feb. 28, 1989

[54] MAKE-UP COVERTURE

[76] Inventor: Marilynn J. Bliss, 259 W. Brown, Birmingham, Mich. 48009

[21] Appl. No.: 464,469

[22] Filed: Feb. 7, 1983

[51] Int. Cl.[4] ..... A45D 40/30

[52] U.S. Cl. ..... 132/319; 2/174

[58] Field of Search ..... 132/88.5, 88.7, 79; 2/9, 206, 174–183, 52; D28/9, 36, 99

[56] References Cited

U.S. PATENT DOCUMENTS

| | | | |
|---|---|---|---|
| 926,555 | 6/1909 | Ernest . | |
| 969,491 | 9/1910 | Payne . | |
| 1,283,357 | 10/1918 | Thompson . | |
| 1,907,476 | 5/1933 | Ballard et al. | 132/88.5 |
| 1,913,083 | 6/1933 | Kroha . | |
| 2,007,353 | 7/1935 | Tarantous | 2/174 |
| 2,033,691 | 3/1936 | Douglass | 2/174 |
| 2,260,614 | 10/1941 | Freitas | 132/88.5 |
| 2,392,377 | 1/1946 | Golding | 2/174 X |
| 2,432,767 | 12/1947 | Klein | 2/174 |
| 2,573,537 | 10/1951 | Bouffard | 2/174 |
| 3,038,470 | 6/1962 | Campbell | 2/174 X |
| 3,249,113 | 5/1966 | Sobeck | 132/9 |
| 3,828,366 | 8/1974 | Conrad | 2/9 |

FOREIGN PATENT DOCUMENTS

| | | | |
|---|---|---|---|
| 1300954 | 7/1962 | France | 132/88.5 |

OTHER PUBLICATIONS

Sagarin–Cosmetics–1957–p. 664.

*Primary Examiner*—Richard J. Apley
*Assistant Examiner*—Robert Bahr
*Attorney, Agent, or Firm*—Gifford, Groh, Sheridan, Sprinkle & Dolgorukov

[57] ABSTRACT

A coverture for protecting a portion of the face from make-up during application of the make-up to the face comprises a shield having at least one make-up impervious section and a means for holding the shield adjacent the protected portion of the face during the application of the make-up. Additionally, a method of applying make-up to a first portion of the face comprises the steps of holding a shield adjacent a second portion of the skin to which make-up is not to be applied, applying make-up to the fast portion of the face, and removing the shield from the first portion of the face, wherein the shield has at least one make-up impervious portion.

14 Claims, 1 Drawing Sheet

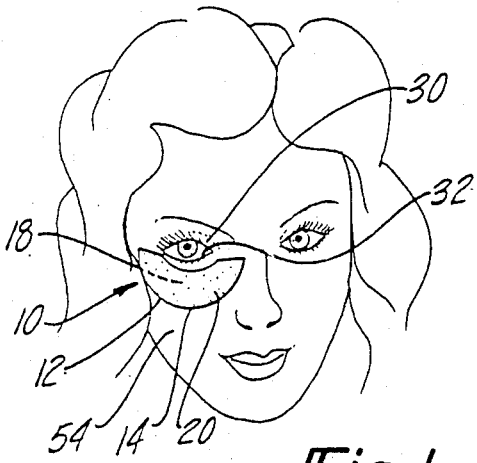
Fig-1
Fig-2
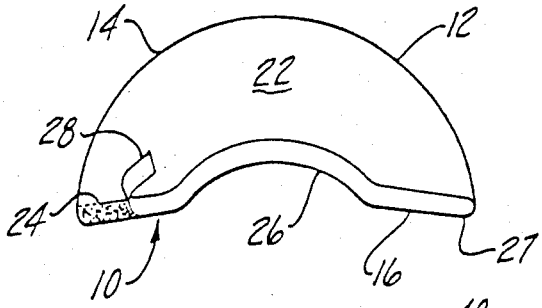
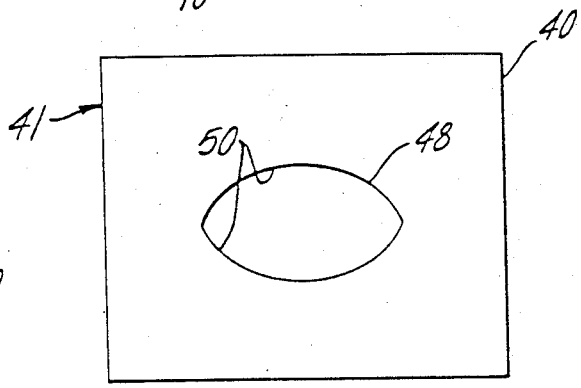
Fig-3
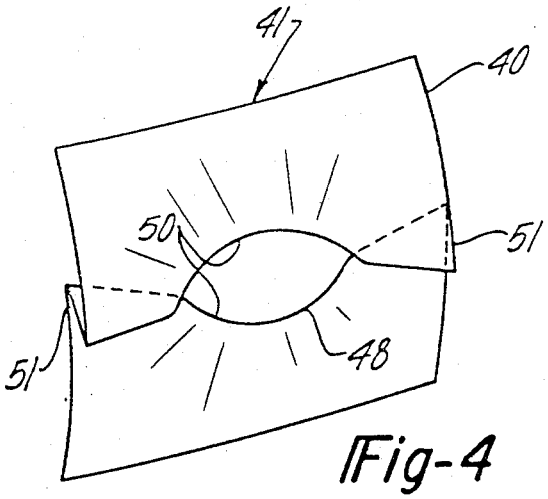
Fig-4
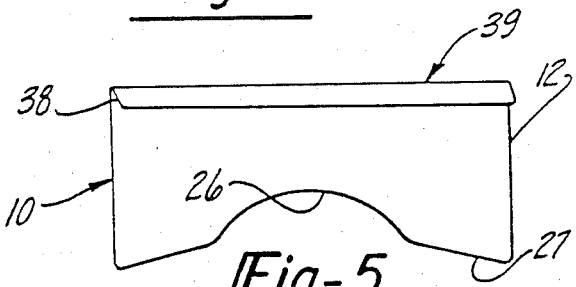
Fig-5
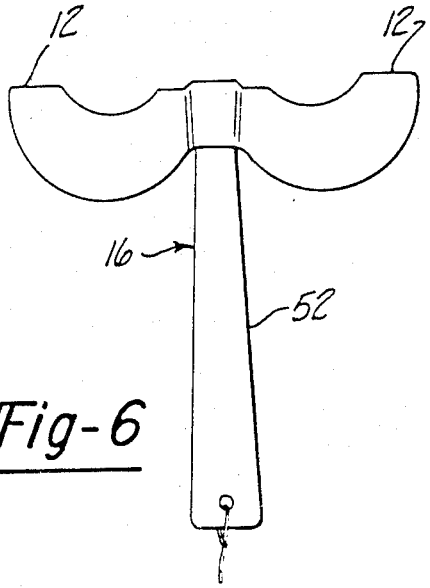
Fig-6
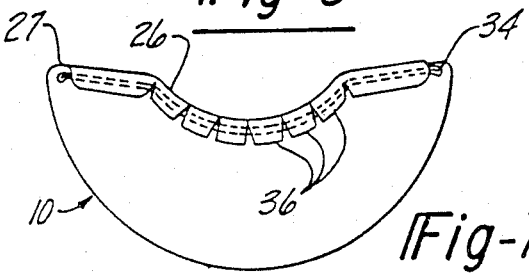
Fig-7
Fig-8
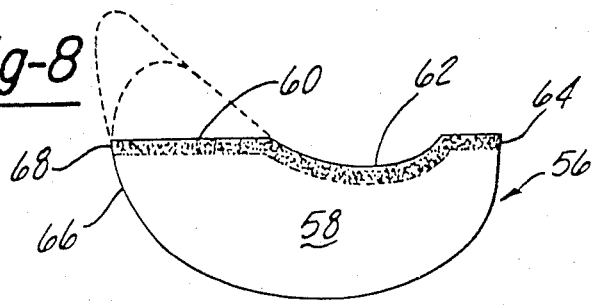

MAKE-UP COVERTURE

FIELD OF THE INVENTION

The present invention is directed to a method and an aid for applying make-up to the skin, and more particularly to a coverture for preventing the inadvertent application of make-up to particular selected portions of the face during the use of make-up.

BACKGROUND OF THE INVENTION

The use of make-up on the human body has long been known. In particular, there is a long history of applying make-up to the eye to enhance the appearance of the eyebrows and the eyelashes, and by use of eyeshadow on the eyelids, thereby enhancing the overall appearance of the eyes.

One problem that has arisen with the use of make-up is the tendency of individual particles of make-up to be inadvertantly scattered about the face during application of make-up to a particular portion of the face. Additionally, the individual applying make-up often rests one or more fingers on the cheek underneath the eye in order to provide support for the other fingers actually applying the make-up. If the supporting fingers are accidentally contaminated by make-up the make-up may be spread across the cheek. Substantial time or effort may be necessary to clean the unwanted make-up from the face, and such cleaning may also adversely affect the make-up which has been previously and properly applied to the face.

SUMMARY OF THE PRESENT INVENTION

The present invention overcomes these and other problems in the make-up parts by providing a coverture which is lightweight and easily used, yet has one or more make-up impervious portions lying adjacent protected portions of the face in order to prevent the accidental or inadvertent application of make-up to those protected portions of the face. The coverture includes means for holding these protective or shield portions in position adjacent the portion of the face to be protected.

The coverture is constructed of a thin and substantially flat material which may be deformed or deformable, either in manufacture or prior to or during use, which preferably consists of tissue paper. The holding means preferbly comprises a skin adhesive strip on a shield which permits the coverture to be easily engaged with and disengaged from the skin. Advantageously, the coverture may be structurally reinforced by folding, or by having a length of wire running in or along the edge of the coverture.

A preferred embodiment of the coverture of the present invention has a holding means comprising a paper covered, skin adhesive strip, the paper being removable to expose the adhesive. This adhesive strip is disposed along the inner edge of the coverture which lies closely adjacent the eye in use and conforms in shape to the curvature of the eyelid.

A method for the use of the coverture in applying make-up is also provided and comprises holding the coverture adjacent the portion of the face to be protected, applying make-up to a different and unprotected portion of the face, and removing the coverture from the protected portion of the face.

The coverture can, of course, protect an area of the face any time material is brought near the face or eye. For example, the coverture can protect rouge or make-up on the cheek of a user when it is desired to apply eye drops to the eye. The coverture acts as a rest for the fingers and lessens the likelihood of smearing any make-up on the cheek or near the eye.

The coverture is also useful as a protector or tool in various medical applications.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a perspective view of a preferred embodiment of the present invention;

FIG. 2 is a rear view of the preferred embodiment of the present invention shown in FIG. 1;

FIG. 3 is a front view of another preferred embodiment of the present invention;

FIG. 4 is a rear view of the preferred embodiment of the present invention shown in FIG. 3;

FIG. 5 is a front view of another preferred embodiment of the present invention;

FIG. 6 is a front view of another preferred embodiment of the present invention;

FIG. 7 is a front view of another preferred embodiment of the present invention; and FIG. 8 is a rear view of another preferred embodiment of the present invention.

DETAILED DESCRIPTION OF THE PREFERRED EMBODIMENTS OF THE PRESENT INVENTION

With reference now to FIGS. 1 and 2, the coverture 10 according to the present invention is thereshown and comprises a shield 12, at least a portion 14 of which is make-up impervious, and a means 16 for holding the shield 12 in place adjacent a portion 18 of the face which is to be protected from make-up. The term "make-up impervious" should be taken to mean that the material of the shield is such that if make-up comes in contact with either a front surface 20 or a rear surface 22 of the shield 12, then that make-up will not be passed through the shield 12 or transported to the other of the rear surface 22 or the front surface 20 of the shield 12.

The holding means 16 comprises a strip of detachably skin-adhesive material 24 at the inner edge 26 of the coverture 10. The material 24 permits easy removal of the coverture 10 from the protected portion 18 of the face, and is covered with a removable paper strip 28 for protection prior to use of the coverture 10.

The coverture 10 consists of tissue paper so that it is substantially flat yet is deformable so as to drape over the curved protected portion 18 of the face. The shield 12 is thereby held closely adjacent the skin on the protected portion 18 of the face, and matches the contours of the protected portion 18 of the face. This minimizes intrusion of inadvertently scattered make-up between the rear surface 22 of the shield 12 and the protected portion 18 of the face.

The coverture 10 has a curvilinear inner edge 26 having an edge portion 27 whose radius of curvature is about equal to the distance from the inner edge 26 and to the center of the eye 30. This distance is determined when the coverture 10 is in place. The edge portion 27 of the coverture 10 thus follows the curve of an eyelid 32 and lies closely adjacent thereto.

The shield 12 is substantially smaller than the face, so that while only a limited area of the face is protected by the coverture 10 the coverture 10 may fit the protected portion 18 of the face closely.

The use of the coverture 10 in applying make-up to or near the eye while preventing the inadvertent or accidental application of make-up to a protected portion 18 of the face can now be easily explained. First, the portion 18 of the face for which protection is desired is selected. The paper strip 28 is removed from the skin adhesive material 24, and the coverture 10 is placed over the protected portion 18 of the face so that the curvilinear inner edge portion 27 of the coverture 10 lies adjacent the eyelid 32, while the material 24 adheres to the skin and holds the shield portion 12 in place closely adjacent the protected portion 18 of the face.

Make-up is then applied to the eye without fear of inadvertent application of make-up to the protected portion 18 of the face. The coverture 10 permits the fingers of the user to be supported by the protected portion 18 of the face without directly contacting it. Application of make-up to the protected portion 18 is thereby prevented even if the fingers are contaminated with make-up. Any make-up, from the fingers or otherwise, that contacts the front surface 20 of the shield 12 will not transfer to or pass through to the rear surface 22 and the protected portion 18 of the face.

Once the application of make-up to the eye is completed, the adhesive bond between the adhesive material 24 and the skin is broken by lifting the coverture 10 from the protected portion 18 of the face and thus the shield 12 is removed from its position adjacent the protected portion 18.

Many modifications to the above-described embodiment can be made. The shield 12 may consist of any material which is deformable during use or which is formed before use to match the contours of the protected surface 18. Materials of a pressed nature are often advantageously deformable, and include bond paper, rag paper, reed paper, wood paper, vegetable paper, fruit paper, tissue paper, rice paper, parchment, vellum, papyrus, paperterie, paper leaf, paper foil, paper fiber, paper wafer, rubber sheet, plastic sheet, acetate sheet, and metal foil. Materials which are advantageously deformable during manufacture (so that the shield 12 is formed prior to use) include paperterie, papier mache, rubber, plastic, acetate, metal, and glass. In many of the latter cases the shield that results is substantially rigid, and can serve as a support for the fingers during use.

If it is desired to add some rigidity to the coverture 10 yet still retain flexibility, the coverture can be structurally reinforced (FIG. 7) by means 33 such as a wire 34 disposed at the inner edge 26 of coverture 10. The wire ends are looped to as to present no sharp or damaging edges. Preferably, the wire 34 is retained on the coverture 10 by gores 36 extending from the shield 12 and wrapping around the wire 34. Structural reinforcement may also occur by appropriately positioned folds or creases (not shown).

As best shown in FIG. 5, a fold 38 disposed on the front side of the coverture 10 but on an edge 39 opposite the inner edge 26 acts as a trough to catch excess make-up that falls on, but is not retained by, the shield 12. This prevents the excess make-up from contaminating other portions of the skin, the clothing, or the surroundings.

Another modification to the invention is changing the shape of the shield portion 12. The shield 12 may be oblong, conical, square, rectangular, or triangular, but one advantageous preferred embodiment of the invention is shown in FIGS. 3 and 4 and comprises a coverture 41 having a shield 40 with an approximately eye-shaped and sized hole 48 therein. The shield 40 may be disposed entirely about the eye and protect a larger area than does the shield 12. The hole 48 has a pair of edges 50, each of which is preferably shaped similarly to the inner edge 26 of the coverture 10 when the edge 39 is used about the eye. The pleats 51 permit the coverture 10 to fit closely to the curved area of the face near the eye.

Another advantageous preferred embodiment of the present invention is shown in FIG. 8 and comprises a coverture 56 having a shield 58 with an inner edge 60. The inner edge 60 comprises a first edge portion 62 which is shaped substantially the same as the portion 27 of the curvilinear edge 26. The inner edge 60 is different from the edge 26 in that the first edge portion 62 is not disposed symmetrically on the edge 60 of the shield 58. Instead, the first edge portion 62 is offset towards one corner 64 of the shield 58. The corner 64 is of substantially square shape, so as to permit a more matching fit of the coverture 56 to the eyelid 32.

An outer curvilinear edge 66 of the shield 58 is disposed a generally increasing distance from the first edge portion 62, progressing from the corner 64 and to a second corner 68.

The corner 68 serves as a grip for manual placement of the coverture 56. The corner 68 is shown extending only far enough so that the shape of the coverture 56 is generally semicircular. The corner 68 can, however, extend as shown in phantom in FIG. 8 to serve as a grip.

Of course, if it is desired to protect some area of the body other than that around the eye, when it is some area other than the eye to which make-up will be applied, the coverture 10 may be sized and shaped accordingly.

Additionally, the invention may be modified by the use of some other holding means 16 to hold the shield 12 in place adjacent the protected portion 18 of the face (or body). As shown in FIG. 6, the holding means 16 may comprise a grip or handle 52 to which at least one shield 12 is attached, preferably a pair of shields 12. The person applying the make-up holds the handle 52 so as to place the shields 12 closely adjacent the protected portion of the face.

Other holding means 16 such as a strip of water or saliva soluble glue may be used as well. The structurally reinforcing means 33 can also comprise plastic or string retained by the gores 36.

Additionally, there may be decorative designs placed upon the coverture 10, or the coverture 10 itself may be of a decorative shape. The edge 26 of the coverture 10, or any of its other edges, may act as a stencil or as a guide to the placement of make-up on a second unprotected portion 54 of the face.

The corners and edges described herein can be appropriately curved, rolled, or shaped to protect the user from paper cuts and the like. Identification of the proper side or edges of the coverture 10 can occur by special shaping of the edges, or the presence of glue or visible indicia on a side of the shield 12.

The detachably skin adhesive material may comprise water soluble glue or cement, or other gum, paste, plaster, mucilage, or any similar material safe to apply near the eye. The material used for the shield may be covered or impregnated with any of these, so that part or all of the rear side of the shield is attachable to the skin.

In another embodiment of the invention the coverture can be used as a protector for the skin in various medical applications. For example, the coverture can protect both the skin and make-up during administration of the eye drops to the eye. The fingers of the individual applying the eye drops can rest upon the shield 12 during the application of the drops. This permits more steady and precise application of the eye drops while preventing smearing of the make-up on either the face or the fingers. Alternatively, the coverture can be applied directly to the eyelid to hold it in position during examination of or surgery on the eye.

The coverture can also hold medical sensing devices in position relative to any part of the body by attaching the device to the shield 12 and positioning the device between the body and the coverture 10.

The coverture can be absorbent so as to absorb bodily fluids while being in a fixed position relative to the body. The coverture of any of the above embodiments can also be impregnated with a medicant, for the purpose of application to the skin or other purpose as such medicant may typically have. In such cases the material of the shield 12 can comprise surgical gauze or other material of sufficiently impermeable, tinsel, flexible or rigid quality.

Having described may invention, however, many modifications thereto will become apparent to those skilled in the art to which it pertains without deviation from the spirit of the invention as defined by the scope of the appended claims. For example, the coverture 10 may be used to protect previously applied make-up during the introduction of eye drops into the eye, the coverture serving as a finger support.

I claim:

1. A coverture for protecting a first portion of a user's face from make-up during the application of said make-up to a second portion of said face, said coverture comprising: a shield having at least one make-up impervious section, said shield being substantially flat but deformable to conform to the contours of said first portion of said face, and said shield including a curvilinear inner edge disposable adjacent the eye of said user but slightly spaced therefrom; and means for holding said shield closely adjacent to said first portion of said face during the application of said make-up to said second portion of said face, said holding means comprising a detachably skin adhesive material disposed on said shield adjacent to said inner edge of said shield.

2. The invention according to claim 1 wherein said shield comprises a material selected from the class consisting of: bond, rag, weed, wood, vegetable, fruit, rice and tissue paper; parchment; vellum; papyrus; paperterie; paper leaf; paper foil, paper fiber; paper wafer; rubber; plastic; acetate; and metal foil.

3. The invention according to claim 1 wherein said coverture additionally comprises a structurally reinforcing portion disposed adjacent said curvilinear inner edge of said shield.

4. The invention according to claim 3 wherein said structurally reinforcing portion comprises a wire disposed along said inner edge of said shield.

5. The invention according to claim 3, wherein said coverture further comprises a trough opposite said curvilinear inner edge for catching make-up not retained by said shield.

6. The invention according to claim 1 wherein said coverture additionally comprises means for directing the application of said make-up to said second portion of the face.

7. The invention according to claim 1 wherein said shield is substantially smaller than the face so that said coverture protects only a limited area of the face and so that said shield can be more closely conformed by said user to the contours of said first portion of the face.

8. The invention according to claim 1 wherein said holding means additionally comprises a grip attached to said at least one shield.

9. The invention according to claim 1, wherein said inner edge follows the curve of the eyelid of said user.

10. The invention according to claim 1, wherein said adhesive material comprises a water soluble glue.

11. The invention according to claim 1, wherein said coverture further compromises a trough opposite said curvilinear inner edge for catching make-up not retained by said shield.

12. A method for applying make-up to the face, wherein the application of make-up is applied to a second portion of the face, said method comprising the steps of:

disposing a coverture on said first portion of the face, said coverture comprising: a shield having at least one make-up impervious section, said shield being substantially flat but deformable to conform to the contours of said first portion of the face, and said shield including a curvilinear inner edge disposable adjacent the eye of said user but slightly spaced therefrom; and means for holding said shield closely adjacent said first portion of the face during the application of said make-up to said second portion of the face, said holding means comprising a detachably skin adhesive material disposed on said shield adjacent to said inner edge of said shield;

applying make-up to said second portion of the face; and removing said coverture from said first portion of the face.

13. The invention according to claim 12, additionally comprising the step of deforming said shield to conform to the contours of said first portion of the face, prior to said applying step.

14. The invention according to claim 12, wherein said disposing step is carried out employing a coverture wherein said adhesive material comprises a water soluble glue, and wherein said method additionally comprises moistening said glue prior to disposing said coverture on said first portion of the face.

* * * * *